US005192008A

United States Patent [19]

Hwan

[11] Patent Number: 5,192,008

[45] Date of Patent: Mar. 9, 1993

[54] PULLING MECHANISM OF AN ADHESIVE-DISPENSING GUN

[75] Inventor: Chi-Chuan Hwan, Chunghua Hsien, Taiwan

[73] Assignee: Dai Shyun Enterprise Co., Ltd., Changhua Hsien, Taiwan

[21] Appl. No.: 824,394

[22] Filed: Jan. 23, 1992

[51] Int. Cl.[5] ..... B67D 5/42

[52] U.S. Cl. ..... 222/391; 222/326; 74/141.5

[58] Field of Search ..... 222/326, 327, 391; 74/141.5, 538

[56] References Cited

U.S. PATENT DOCUMENTS

| | | | |
|---|---|---|---|
| 2,582,156 | 1/1952 | Peterson | 222/391 |
| 2,731,176 | 1/1956 | Crewe | 222/391 |
| 2,786,604 | 3/1957 | Collins | 222/391 |
| 4,081,112 | 3/1978 | Chang | 222/391 |

*Primary Examiner*—Andres Kashnikow
*Assistant Examiner*—Philippe Derakshani
*Attorney, Agent, or Firm*—Bacon & Thomas

[57] ABSTRACT

A pulling mechanism of an adhesive-dispensing gun, comprising a gun barrel having a rear wall, a gun base, a trigger and a push rod, wherein a stopper plate is pivotably disposed in the gun base and formed with a hole through which the push rod extends, and wherein a push plate is disposed in the gun base and formed with a hole through which the push rod extends, a first and a second springs being fitted on the push rod on two sides of the stopper plate, one end of the first spring contacting the rear wall of the gun barrel for pushing the stopper plate, one end of the second spring being used to push the push plate, the lower end of the push plate being driven by the trigger to push the push rod forward, a torque spring being disposed on a pivot of the trigger to restore the trigger back to its home position and push the stopper plate out of the stopping position, whereby the push rod can be directly pulled back and once the trigger is released, the push rod is free from any pressure and no excessive adhesive will be dispensed.

1 Claim, 6 Drawing Sheets

PULLING MECHANISM OF AN ADHESIVE-DISPENSING GUN

BACKGROUND OF THE INVENTION

The present invention relates to an improved pulling mechanism of an adhesive-dispensing gun, wherein a push plate is disposed in a gun base to be driven by a trigger to push a push rod forward, and a stopper plate is disposed in the gun barrel to stop the push rod and prevent the same from moving backward, permitting the same to further move forward, whereby when the trigger is released, a torque spring will restore the trigger back to its home position to contact the stopper plate and push the same out of the stopping position so that the push rod can be directly pulled back without biasing the stopper plate with a finger.

A conventional adhesive-dispensing gun is shown in FIG. 1, wherein a push rod 2 extends through a gun base 1 into a gun barrel 3. A push plate 4 is fitted on the push rod 2 between a rear wall 11 of the gun base 1 and a rear wall 31 of the gun barrel 3. A spring 5 is fitted on the push rod 2 between the push plate 4 and the rear wall 31. A pivotable stopper plate 6 is fitted on the push rod 2 behind the rear wall 11. A spring 7 is disposed between the stopper plate 6 and the rear wall 11. A trigger 8 is pivotably disposed in the gun base 1.

As shown in FIG. 2, the push rod 2 is moved forward in such a manner that the trigger 8 is triggered to bias the push plate 4 which further pushes the push rod 2 forward. The moving forward push rod 2 must be prevented from moving rearward by a stopping force while when the trigger 8 is again triggered, the push rod 2 must further move forward. The stopper plate 6 is biased by the spring 7 to be oriented at an angle $\theta$ with respect to the push rod 6 so as to stop the push rod 2 and prevent the same from moving backward. However, this also makes the adhesive container located in the gun barrel 3 still under a pressurized state by the push rod 2 after the push rod 2 is released. As a result, the adhesive is often further dispensed outside until the pressure disappears. Such further dispensed adhesive is not used and wasted.

As shown in FIG. 3, when the push rod 2 is pushed to the end of the gun barrel, the stopper plate 6 must be pressed by a finger to eliminate the angle $\theta$ and the stopping force so as to pull back the push rod 2. Such procedure is quite troublesome.

SUMMARY OF THE INVENTION

It is therefore a primary object of this invention to provide an adhesive-dispensing gun wherein the push rod can be directly pulled back when reaching the end of the gun barrel without pressing the stopper plate and no excessive adhesive will be dispensed outside.

According to the above object, the present invention includes a gun barrel having a rear wall, a gun base, a trigger and a push rod, wherein a stopper plate is pivotably disposed in the gun base and formed with a hole through which the push rod extends, and a push plate is disposed in the gun base and formed with a hole through which the push rod extends. A first spring is disposed on the push rod between the rear wall and the stopper plate. A second spring is disposed on the push rod between the stopper plate and the push plate. A pivot rod is welded at the upper end of the stopper plate. The stopper plate is formed with a lower bent portion which contacts the trigger while the lower end of the push plate contacts the trigger to be driven thereby. A torque spring is disposed on a pivot of the trigger to restore the trigger back to its home position after triggered, whereby the stopper plate is pushed out of the stopping position and the push rod is free from any force and thus can be pulled back freely. When the trigger is again triggered, the force exerted on the stopper plate is eliminated and the first spring again pushes the stopper plate to the stopping position to prevent the push rod from moving backward so that the push plate can further push the push rod forward up to the end of the gun barrel. When the push rod reaches the end of the gun barrel, the push rod can be directly pulled back. At this time, no pressure exists in the gun barrel so that no excessive adhesive will be dispensed outside.

The present invention can be better understood through the following description and accompanying drawings wherein:

DETAILED DESCRIPTION OF THE PREFERRED EMBODIMENTS

Figure 1:
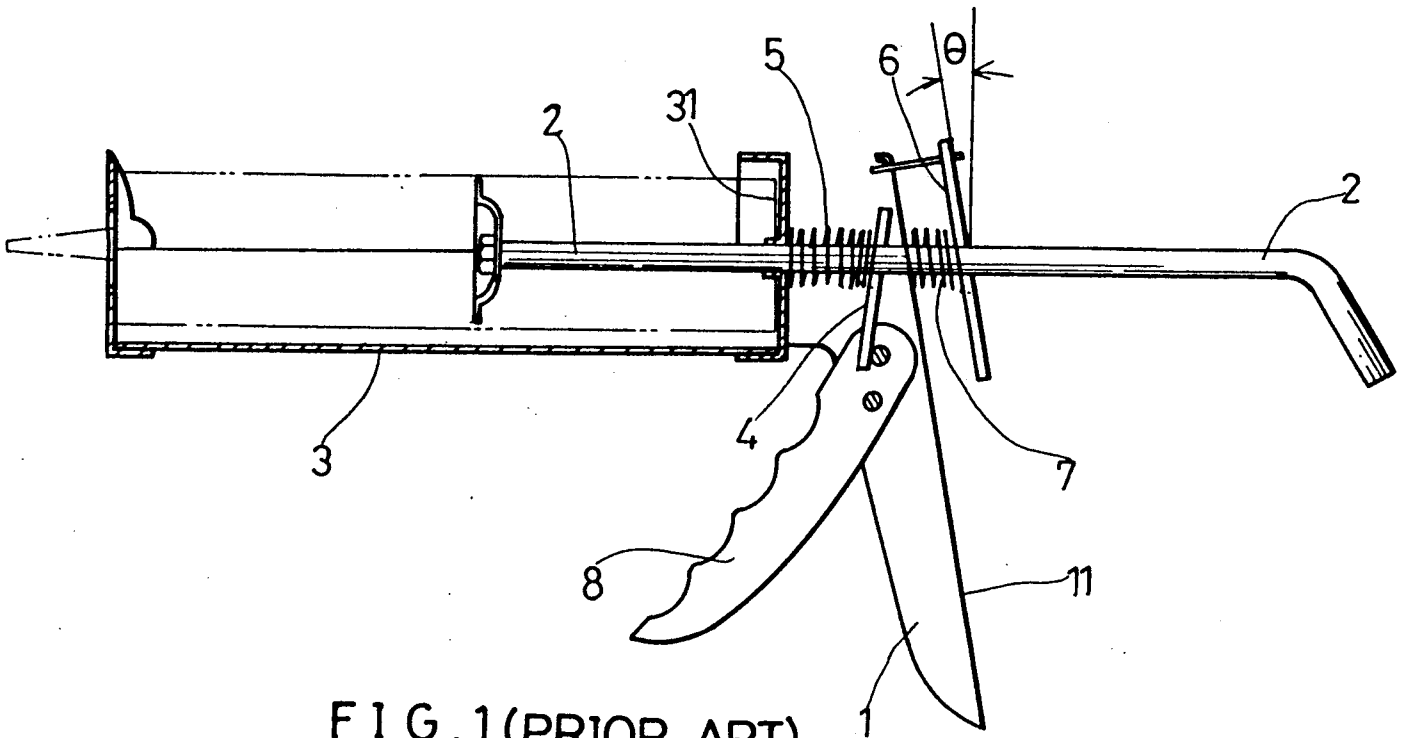
FIG. 1 (PRIOR ART)
FIG. 1 is a sectional view of a conventional adhesive-dispensing gun.
Figure 2:
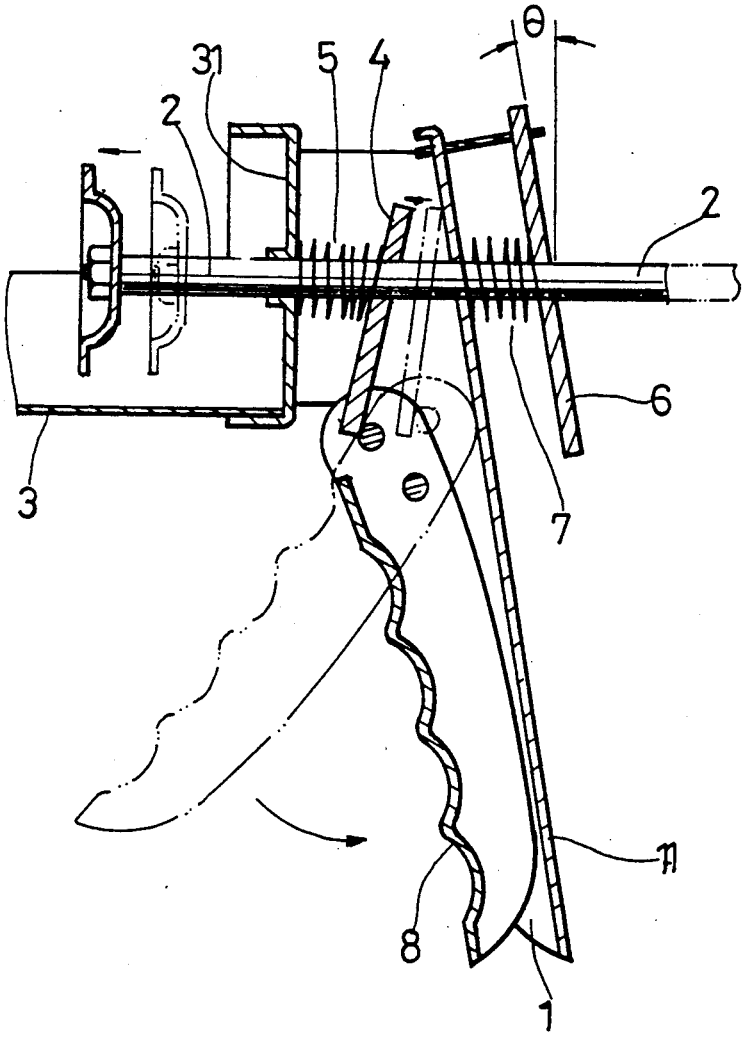
FIG. 2 (PRIOR ART)
FIG. 2 is a view according to FIG. 1, showing the forward movement of the push rod for dispensing the adhesive.
Figure 3:
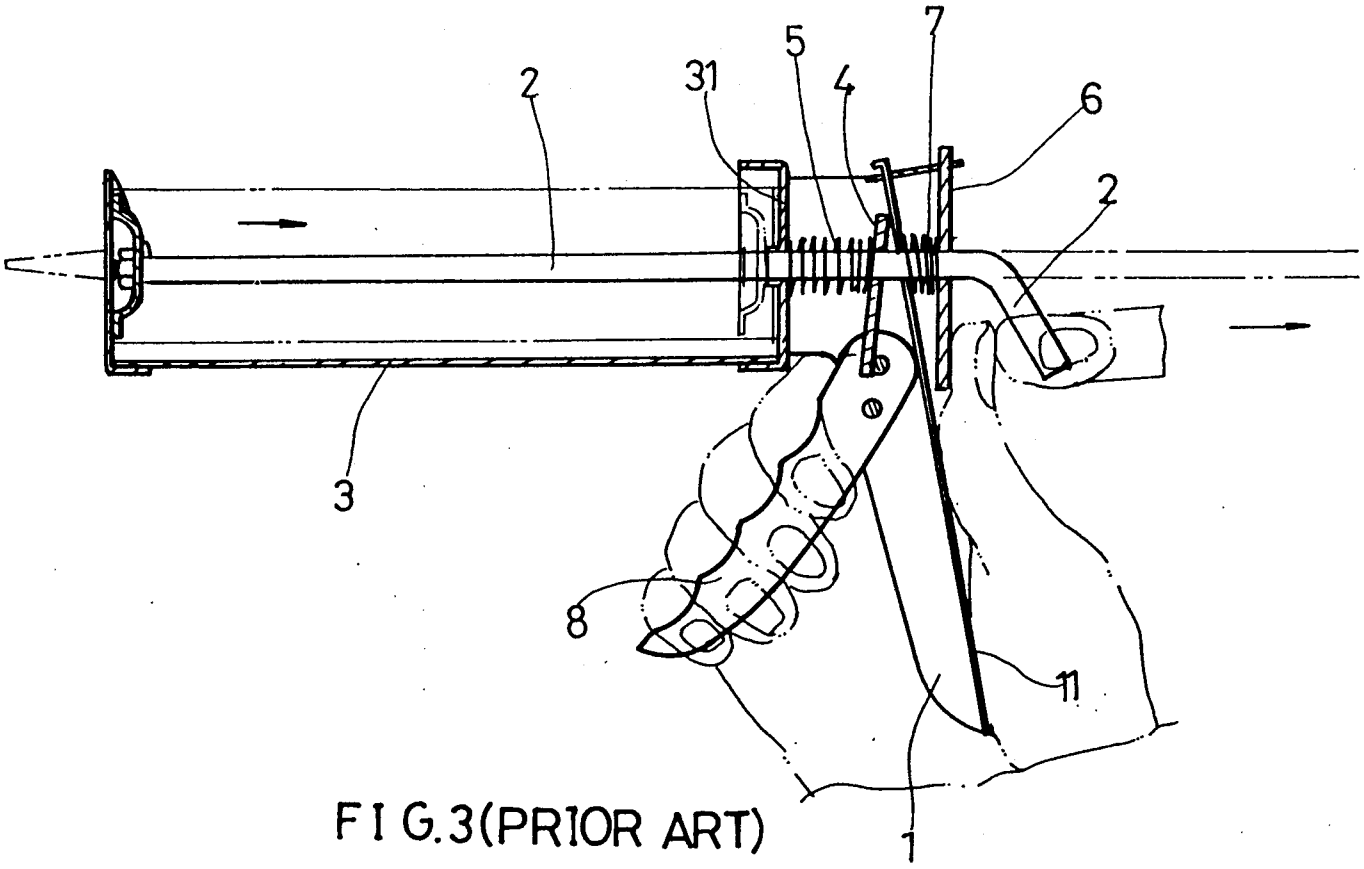
FIG.3(PRIOR ART)
FIG. 3 is a view according to FIG. 1, showing the backward movement of the push rod.
Figure 4:
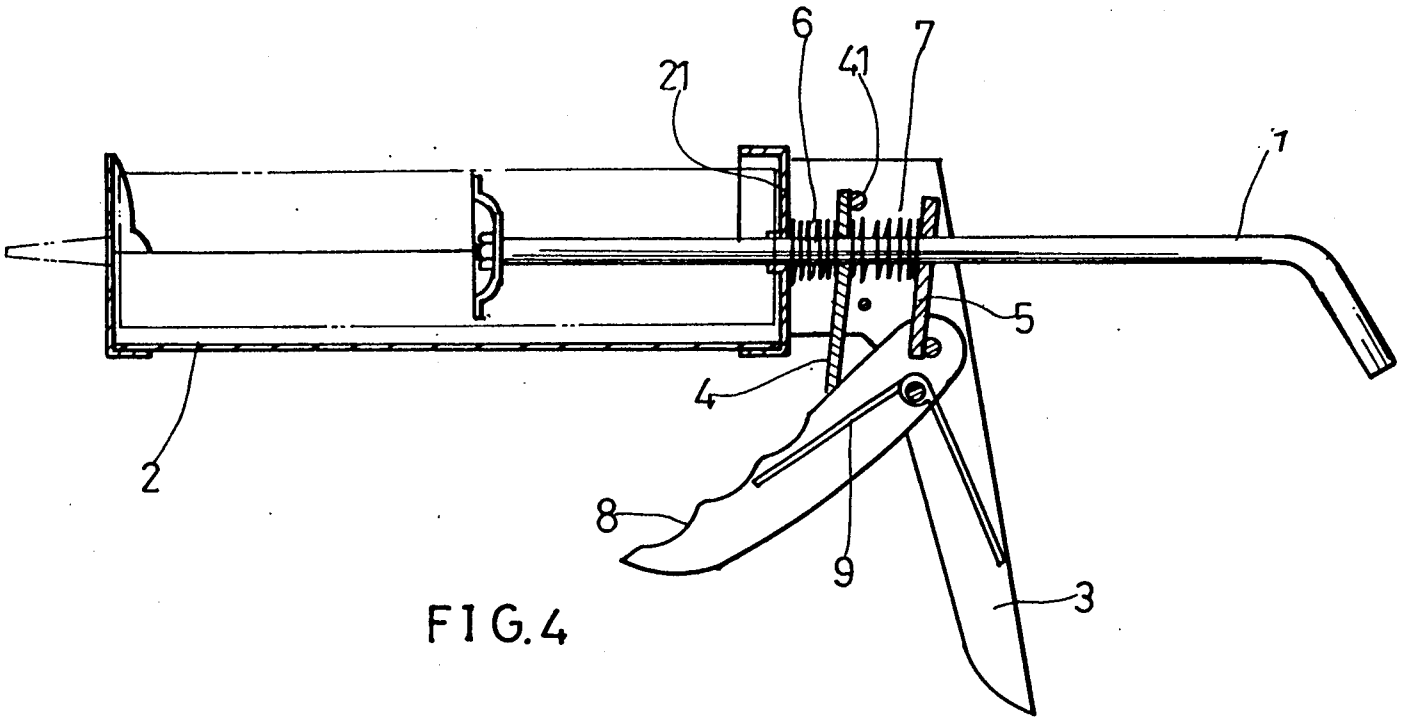
FIG. 4 is a sectional view of this invention.

Please refer to FIG. 4. The present invention includes a gun barrel 2 having a rear wall 21, a gun base 3, a trigger 8 and a push rod 1 extending through the rear wall 21 of the gun barrel 2 to couple with a disk. A stopper plate 4 and a push plate 5 are fitted on the push rod 1 between the rear wall 21 and the gun base 3. A first spring 6 is disposed on the push rod 1 between the rear wall 21 and the stopper plate 4 and a second spring 7 is disposed on the push rod 1 between the stopper plate 4 and the push plate 5. A pivot rod 41 is welded at the upper end of the stopper, plate 4 on two lateral walls of the gun base 3. The stopper plate 4 is formed with a hole through which the push rod 1 extends and formed with a lower bent portion which contacts the trigger 8. The push plate 5 is formed with a hole through which the push rod 1 extends. The lower end of the push plate 5 contacts the trigger 8 to be driven thereby. A torque spring 9 is disposed on a pivot of the trigger 8 to restore the trigger back to its home position after triggered.

Figure 5:
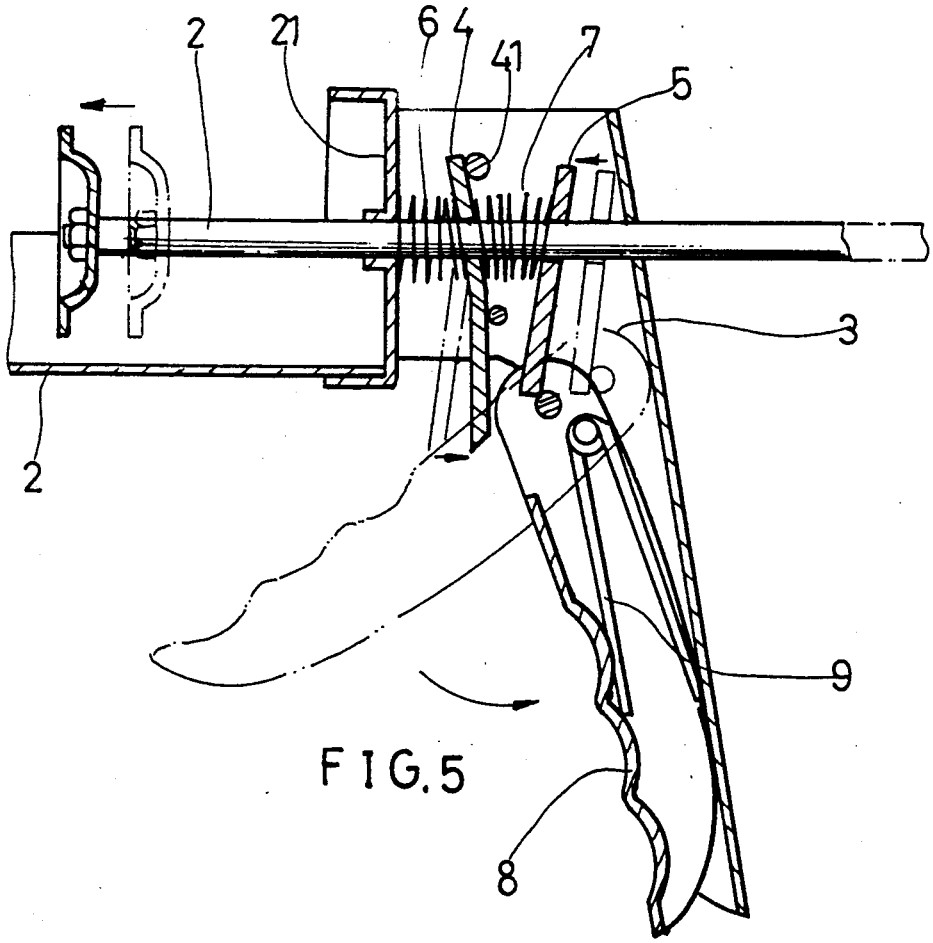
FIG. 5 is a view according to FIG. 4, showing the forward movement of the push rod of this invention for dispensing the adhesive.

As shown in FIG. 5, when the trigger 8 is restored to its home position indicated by the phantom line, the stopper plate 4 is pushed out of the stopping position, while when the trigger 8 is triggered, the pushing force exerted on the lower end of the stopper plate 4 is eliminated so that the first spring 6 pushes the stopper plate 4 toward the stopping position to prevent the push rod 1 from moving rearward, and then the trigger 8 will forward push the push plate 5 as well as the push rod 1 as indicated by the solid line of FIG. 5.

Figure 6:
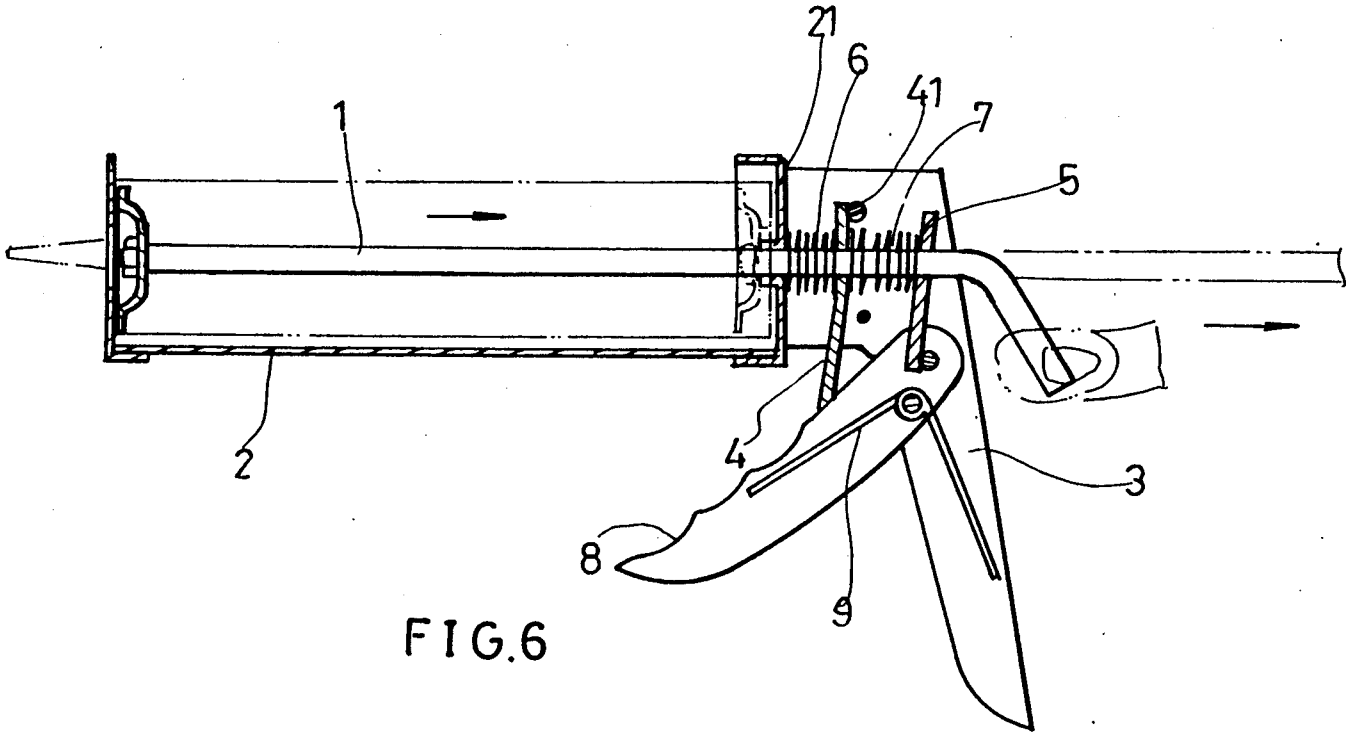
FIG. 6 is a view according to FIG. 4, showing the backward movement of the push rod of this invention.

As shown in FIG. 6, when the trigger 8 is released again, the stopper plate 4 is pushed out of the stopping position. Meanwhile, the stopping force against the push rod 1 is eliminated and thus the push rod can be pulled back to its home position freely. At this time, because the push rod 1 is free from any force, the adhesive contained in the gun barrel 2 is free from any pressure so that no excessive adhesive will be further dispensed.

What is claimed is:

1. An improved pulling mechanism of an adhesive-dispensing gun, comprising a gun barrel having rear wall, a gun base, a trigger and a push rod, said push rod extending through said rear wall of said gun barrel, said pulling mechanism being characterized in that a stopper plate and a push plate are fitted on said push rod between said rear wall and said gun base, a first spring being disposed on said push rod between said rear wall and said stopper plate, a second spring being disposed on said push rod between said stopper plate and said push plate, a pivot rod being welded at the upper end of said stopper plate on two lateral walls of said gun base, said stopper plate being formed with a hole through which said push rod extends and formed with a lower bent portion which contacts said trigger, said push plate being formed with a hole through which said push rod extends, the lower end of said push plate contacting said trigger to be driven thereby, a torque spring being disposed on a pivot of said trigger to restore said trigger back to its home position after triggered, whereby said stopper plate is pushed out of the stopping position and said push rod is free from any force so that no excessive adhesive will be further dispensed and said push rod can be freely pulled back.

* * * * *